US011075032B2

(12) United States Patent
Cheng et al.

(10) Patent No.: US 11,075,032 B2
(45) Date of Patent: Jul. 27, 2021

(54) POWER TRANSFORMERS AND METHODS OF MANUFACTURING TRANSFORMERS AND WINDINGS

(71) Applicant: Astec International Limited, Kowloon (HK)

(72) Inventors: Wo Oi Cheng, Kowloon (HK); Alfredo Belmonte Grueso, Teresa (PH); Chi Wai Kevin Wong, Ma On Shan (HK)

(73) Assignee: Astec International Limited, Kowloon (HK)

( * ) Notice: Subject to any disclaimer, the term of this patent is extended or adjusted under 35 U.S.C. 154(b) by 172 days.

(21) Appl. No.: 16/118,633

(22) Filed: Aug. 31, 2018

(65) Prior Publication Data

US 2018/0374637 A1 Dec. 27, 2018

Related U.S. Application Data

(62) Division of application No. 14/613,858, filed on Feb. 4, 2015, now abandoned.

(51) Int. Cl.
*H01F 41/074* (2016.01)
*H01F 27/28* (2006.01)

(52) U.S. Cl.
CPC ..... *H01F 41/074* (2016.01); *H01F 27/2866* (2013.01)

(58) Field of Classification Search
CPC ..... H01F 41/074; H01F 27/2866
See application file for complete search history.

(56) References Cited

U.S. PATENT DOCUMENTS 4,272,310 A * 6/1981 Dudgeon ..... H01F 41/04 156/172
4,724,604 A * 2/1988 Kawazoe ..... H01F 41/04 29/522.1
5,684,445 A 11/1997 Kobayashi et al.
6,087,922 A 7/2000 Smith
6,859,130 B2 * 2/2005 Nakashima ..... H01F 27/2804 29/602.1
6,972,657 B1 12/2005 Pacala et al.
7,439,839 B2 * 10/2008 Podlisk ..... H01F 5/003 336/200
7,598,839 B1 * 10/2009 Wedley ..... H01F 3/12 336/131
7,830,237 B1 * 11/2010 Chen ..... H01F 17/043 336/220
8,022,804 B2 9/2011 Pilniak et al.
9,000,878 B1 * 4/2015 Lazzerini ..... H01F 27/06 336/229

(Continued)

*Primary Examiner* — Elvin G Enad
*Assistant Examiner* — Malcolm Barnes

(57) ABSTRACT

A power transformer includes at least two first windings, at least two second windings interleaved with the at least two first windings, and a magnetic core. The at least two first windings and the at least two second windings are positioned adjacent the magnetic core. Each first winding includes a wire and a plurality of turns. One or more windings of the at least two first windings include a bonding material and at least two adjacent turns of said plurality of turns adhered to each other via the bonding material. Other example power transformers, methods of manufacturing power transformers, and methods of manufacturing windings are also disclosed.

10 Claims, 7 Drawing Sheets

(56) References Cited

U.S. PATENT DOCUMENTS

2001/0038915 A1* 11/2001 Tamura ..... H01F 41/066
428/375
2005/0046534 A1* 3/2005 Gilmartin ..... H01F 27/306
336/83
2005/0162025 A1* 7/2005 Sivasubramaniam ... H02K 3/14
310/64
2007/0273465 A1* 11/2007 Feng ..... H01F 27/2866
336/212
2008/0088401 A1* 4/2008 Wei ..... H01F 27/289
336/182
2008/0117012 A1* 5/2008 Pilniak ..... H01F 41/122
336/205
2013/0106562 A1* 5/2013 Shafer ..... B29C 43/003
336/84 C
2014/0209729 A1* 7/2014 Benner, Jr. ..... H01F 41/071
242/432
2015/0130577 A1* 5/2015 Hongzhong ..... H01F 27/2866
336/192
2015/0332841 A1* 11/2015 Hasegawa ..... H01F 27/2823
307/104

* cited by examiner

POWER TRANSFORMERS AND METHODS OF MANUFACTURING TRANSFORMERS AND WINDINGS

CROSS-REFERENCE TO RELATED APPLICATION

This application is a divisional of U.S. patent application Ser. No. 14/613,858 filed Feb. 4, 2015. The entire disclosure of the above application is incorporated herein by reference.

FIELD

The present disclosure relates to power transformers and methods of manufacturing transformers and windings.

BACKGROUND

This section provides background information related to the present disclosure which is not necessarily prior art.

Power transformers may include primary windings and secondary windings. In some instances, the primary windings are wire windings and the secondary windings are plate windings. These windings may be interleaved together. In some examples, the primary wire windings are adhered to surfaces of the plate windings.

SUMMARY

This section provides a general summary of the disclosure, and is not a comprehensive disclosure of its full scope or all of its features.

According to one aspect of the present disclosure, a power transformer includes at least two first windings, at least two second windings interleaved with the at least two first windings, and a magnetic core. The at least two first windings and the at least two second windings are positioned adjacent the magnetic core. Each first winding includes a wire and a plurality of turns. One or more windings of the at least two first windings include a bonding material and at least two adjacent turns of said plurality of turns adhered to each other via the bonding material.

According to another aspect of the present disclosure, a method of manufacturing a power transformer includes forming a first winding having a plurality of turns from a wire at least partially covered with a bonding material, heating the bonding material to adhere at least two adjacent turns of said plurality of turns together, and after heating the bonding material, positioning the first winding adjacent a second winding.

According to another aspect of the present disclosure, a method of manufacturing a winding for a magnetic component includes forming a winding having a plurality of turns from a wire at least partially covered with a bonding material, and heating the bonding material to adhere at least two adjacent turns of said plurality of turns together before the winding is positioned adjacent another winding.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Figure 1:
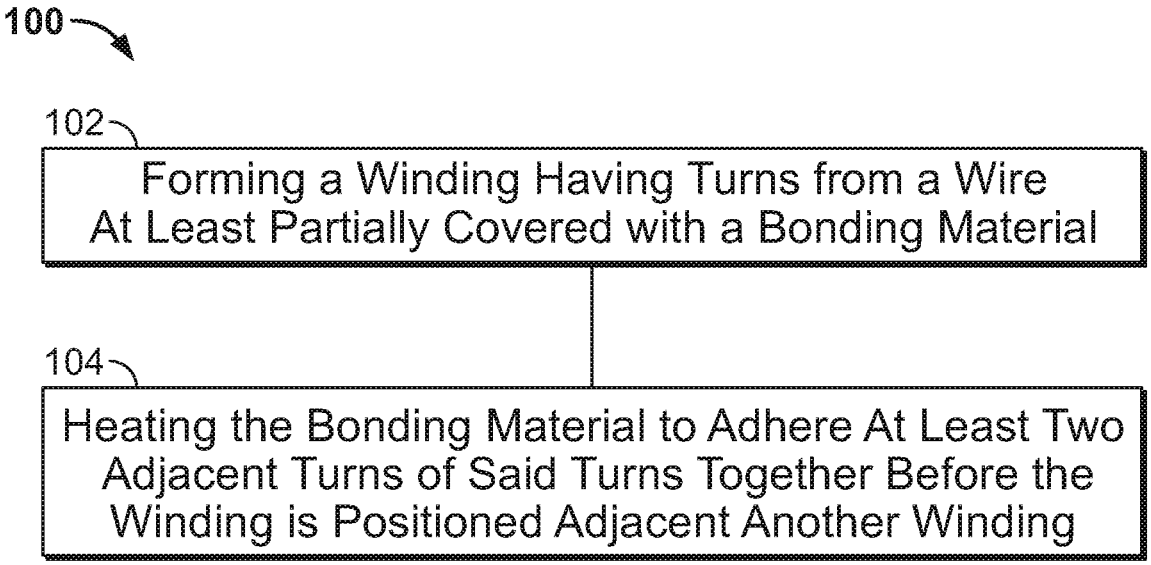
FIG. 1 is a block diagram of a method of manufacturing a winding according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A method of manufacturing a winding for a magnetic component according to one example embodiment of the present disclosure is illustrated in FIG. 1 and indicated generally by reference number 100. As shown in FIG. 1, the method 100 includes forming a winding having turns from a wire at least partially covered with a bonding material in block 102, and heating the bonding material to adhere at least two adjacent turns of the turns together before the winding is positioned adjacent another winding in block 104.

By adhering (e.g., bonding, etc.) adjacent turns of a winding together as explained further below, the winding may form a substantially non-separable winding. For example, the winding including the adhered turns may be non-separable up to a particular pull force. As such, the winding may be easier to manage, include a reduced profile, etc. compared to other windings not including adhered turns.

Additionally, by heating the bonding material to adhere turns together before positioning the winding adjacent another winding, the bonding material will not adhere to this other winding. Thus, the winding having adhered turns and the other winding (e.g., a plate winding, a wire winding, etc.) remain separable, discrete components. As such, the windings may be moved, separated, repaired, replaced, etc. without damaging the windings, aggravation, etc.

In some example embodiments, adjacent turns of any one of the adhered windings disclosed herein may be adhered together by heating the bonding material. As such, the bonding material may change into a softer state thereby allowing the bonding material of adjacent turns to melt together. Thus, the wire forming the winding may be considered a self-bonding wire.

In some examples, the bonding material may be heated to a defined temperature. This defined temperature may include a defined value, a defined range, a defined upper limit, etc. depending on, for example, the bonding material employed, the period of time the bonding material is heated, etc. For example, the bonding material may be heated to a temperature within a range between about 250 degrees Celsius and about 270 degrees Celsius, no more than about 260 degrees Celsius, etc. In other embodiments, the bonding material may be heated to a defined temperature of about 200 degrees Celsius, about 250 degrees Celsius, about 260 degrees Celsius, about 300 degrees Celsius, etc. In some embodiments, the bonding material may cure faster and/or have an increased pull force if higher temperatures are employed.

Additionally, the bonding material may be heated at this defined temperature for a defined period of time. This defined period of time may include any suitable period of time depending on, for example, the applied temperature, the bonding material employed, etc. In some examples, this defined period of time may be about one second, about five seconds, more or less than one second, etc. For example, the bonding material may be heated at about 260 degrees Celsius for about five seconds.

The adjacent turns of the windings may be bonded together by any suitable heat source. For example, the turns may be bonded together by passing heated air across the bonding material. In such examples, the heated air may be provided by a heat source that outputs hot air such as a heat gun, a fan adjacent a furnace, etc. In other examples, the heat source may include an oven, a flame, and/or any other suitable heat source. In such cases, the windings itself and/or the windings and the structure (e.g., core, mandrel, etc.) used to form the windings may be placed adjacent a flame, within an oven, etc.

The adhered winding (and other windings disclosed herein) may be employed in any suitable magnetic component including, for example, a transformer, an inductor, etc. As such, the adhered winding may be a winding of a transformer, a coil of an inductor, etc. When, for example, the winding is employed in a transformer, the winding may have its turns adhered together before positioning the winding adjacent another winding.

Figure 2:
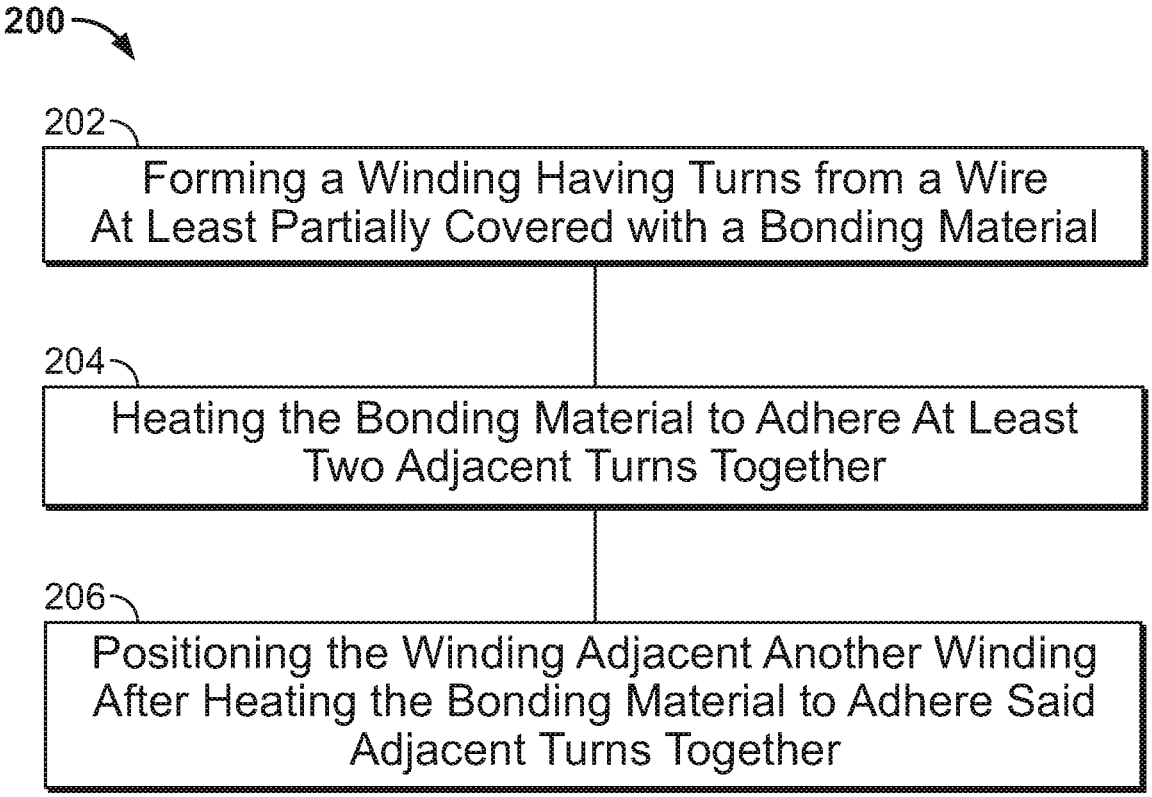
FIG. 2 is a block diagram of a method of manufacturing a power transformer according to another example embodiment.

For example, FIG. 2 illustrates a method 200 of manufacturing a power transformer. As shown in FIG. 2, the method 200 includes forming a winding having turns from a wire at least partially covered with a bonding material in block 202 and heating the bonding material to adhere at least two adjacent turns of the turns together in block 204. After heating the bonding material to adhere the two adjacent turns together (in block 204), the winding may then be positioned adjacent another winding of the power transformer in block 206.

In some examples, one or more of the adhered winding may be used as a primary winding(s) of the power transformer. In such cases, the other winding may be used as a secondary winding of the power transformer. Additionally and/or alternatively, one or more of the adhered winding may be used as a secondary winding(s) of the power transformer. As such, the adhered winding may be the primary winding and/or the secondary winding when employed in a power transformer.

In some embodiments, any one of the adhered windings disclosed herein may be formed on a structure. For example, if the adhered winding is employed in a transformer, this winding may be formed on a magnetic core of the transformer. In such cases, a wire may be wound about a portion of the core to form the winding and then heat may be applied to the winding to bond adjacent turns of the winding. As such, coil formers, winding fixing tapes, etc. typically used to form and/or secure windings may be eliminated by adhering adjacent turns of a winding together as explained herein.

Alternatively, the windings may be formed on another suitable structure. For example, the windings may be formed on a mandrel or the like. In such examples, the mandrel may rotate causing a wire to wind about the mandrel. In other examples, a structure is held substantially stationary and the wire may be wound about the structure. After which, heat may be applied to the winding to bond adjacent turns of the winding while the winding is on the mandrel or another suitable structure. After forming the adhered winding on this structure, this winding may be removed from the structure. This adhered winding and/or other windings (e.g., additional adhered windings, non-adhered windings, etc.) may then be placed in a desired application (e.g., positioned adjacent a core of a transformer in an interleaving configuration, on a circuit board, etc.).

In some examples, the methods of manufacturing a winding as explained herein may be automated. For example, the steps of forming the winding and/or heating the bonding material may be partially automated, fully automated, etc. In such cases, the winding may be formed and/or heated using an automated winding machine. In some cases, the winding may be moved with automated equipment to and/or from various structures after at least one set of adjacent turns are adhered together. For example, the adhered winding may be removed from a mandrel and positioned adjacent a transformer core with an automated machine. As such, the adhered windings may be produced and/or moved without direct interaction from an individual. In some cases, this automation may improve employee safely, improve winding reliability, improve winding consistency, reduce time, reduce costs, etc. compared to methods not employing an automated process.

Figure 3:
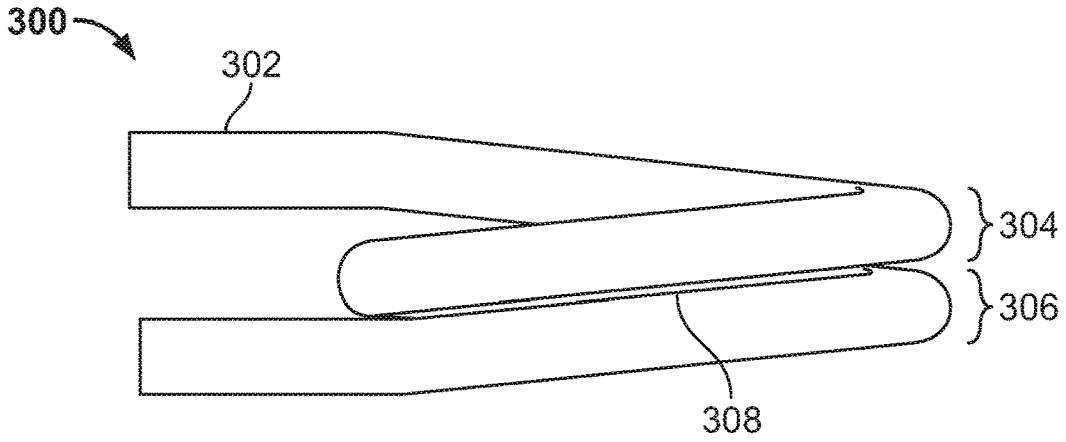
FIG. 3 is a side view of a winding having two turns adhered together according to yet another example embodiment.
Figure 4:
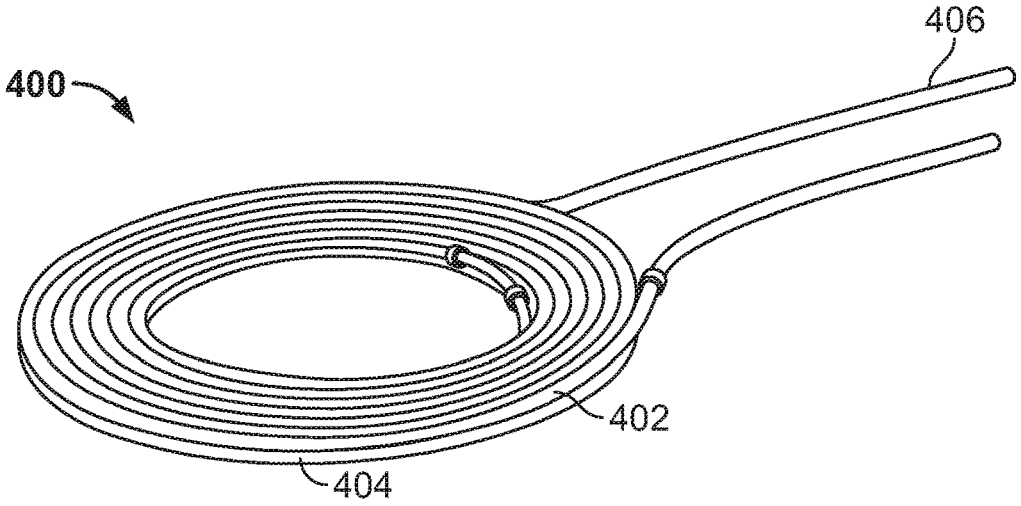
FIG. 4 is an isometric view of a double layer winding including turns adhered together according to another example embodiment.

As explained above, turns of a winding may be adhered together before the winding is positioned adjacent another winding. For example, FIGS. 3 and 4 illustrate example windings 300 and 400, respectively. Although FIGS. 3-4 illustrate particular windings, it should be apparent to those skilled in the art that any suitable winding may be employed with departing from the scope of the disclosure.

As shown in FIG. 3, the winding 300 includes two adjacent turns 304, 306 formed from a wire 302. As shown in FIG. 3, the two adjacent turns 304, 306 are adhered to each other via a bonding material 308. As shown in FIG. 3, the winding 300 may be a double layer winding with respect to a horizontal plane extending through the winding or a single layer winding with respect to a vertical plane extending through the winding.

FIG. 4 illustrates the winding 400 including a layer 402 and a layer 404 positioned on the layer 402. This configuration is commonly referred to as a double layer winding. Each layer 402, 404 includes six turns formed of a wire 406. As shown in FIG. 4, the wire 406 is wound about itself to form the turns of each layer 402, 404 thereby creating a pancake winding.

In the example embodiment of FIG. 4, each of the adjacent turns of each layer 402, 404 are adhered to each other via a bonding material covering at least a portion of the wire 406. For example, the bottom layer 404 may be formed before the top layer 402. After the layer 404 is formed, the bonding material may be heated to adhere adjacent turns of the layer 404. After these turns are adhered together, the layer 402 may be formed on top of the layer 404. After the layer 402 is formed, the bonding material covering this portion of the wire 406 may be heated to adhere adjacent turns of the top layer 402.

Additionally and alternatively, one or more turns of the layer 402 may be adhered to one or more turns of the layer 404. For example, after the layers 402, 404 are formed, heat may be applied to the bonding material adjacent contacting turns of the layers 402, 404 to adhere the two layers 402, 404 together. In some embodiments, the turns of each layer 402, 404 may be adhered together separately and then the layers 402, 404 may be adhered together if desired. In other embodiments the turns of each layer 402, 404 may be adhered together and the layers 402, 404 may be adhered together at the same time.

As explained above, one or more of the adhered windings may be employed in a power transformer. FIGS. 5-8 illustrate various example transformers (and/or a portion thereof) that may include one or more of these adhered windings. Although FIGS. 5-8 illustrate particular transformers, it should be apparent to those skilled in the art that any suitable transformer may be employed with departing from the scope of the disclosure.

Figure 5:
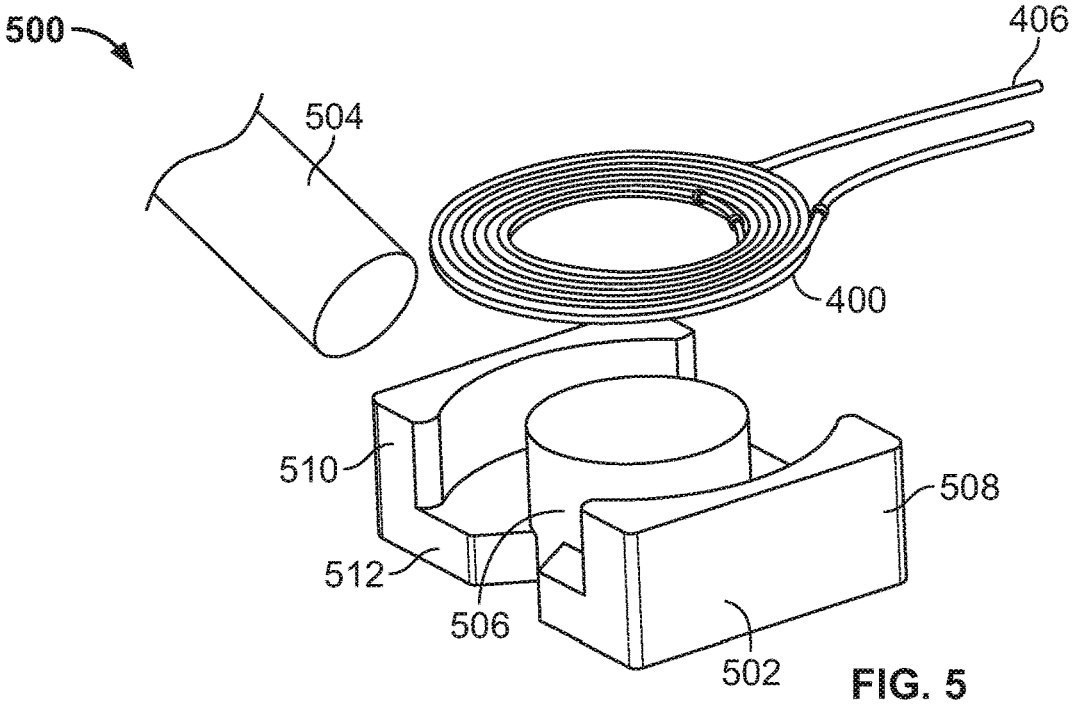
FIG. 5 is an isometric view of a system including a portion of a transformer having the winding of FIG. 4 and a heat gun to heat the winding according to yet another example embodiment.

For example, FIG. 5 illustrates a system 500 including a portion of a transformer having a magnetic core 502 and the winding 400 of FIG. 4. As shown in FIG. 5, the magnetic core 502 includes a yoke 512, an inner leg 506, and two opposing outer legs 508, 510. The legs 506, 508, 510 extend from the yoke 512. This configuration is commonly referred to as a "PQ" shaped core. Alternatively, any other suitable shaped core may be employed without departing from the scope of the disclosure.

In the example of FIG. 5, the winding 400 is formed on the magnetic core 502. For example, and as explained above, the wire 406 may be wound about the inner leg 506 of the core 502 to create the turns of the bottom layer of the winding 400. After one or more of the turns are created, a heat source (e.g., a heat gun 504 of FIG. 5) may be employed to heat the bonding material covering the wire 406 to adhere adjacent turns together. The top layer of the winding 400 may be formed in a similar manner. In other embodiments, both layers of the winding 400 may be formed on the core 502 before heating the bonding material. In such examples, adjacent turns of each respective layer are adhered together and the layers are adhered together.

Figure 6:
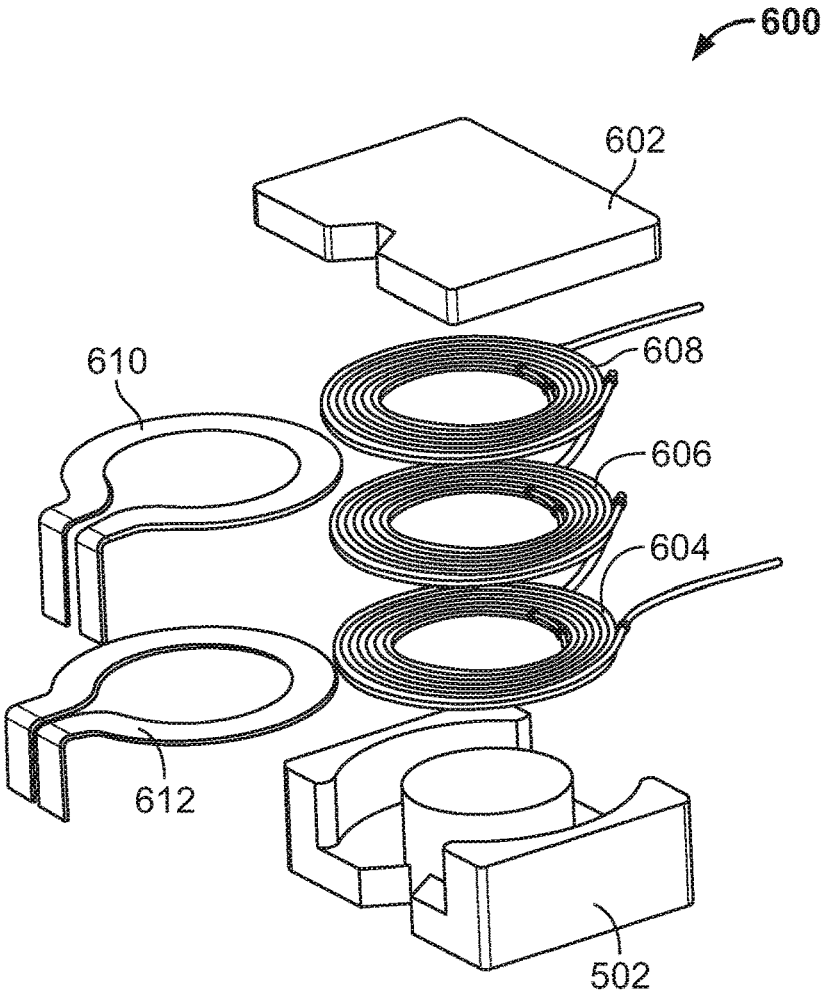
FIG. 6 is an exploded isometric view of a transformer including three primary windings each having turns adhered together and two secondary plate windings interleaved with the primary winding according to another example embodiment.
Figure 7:
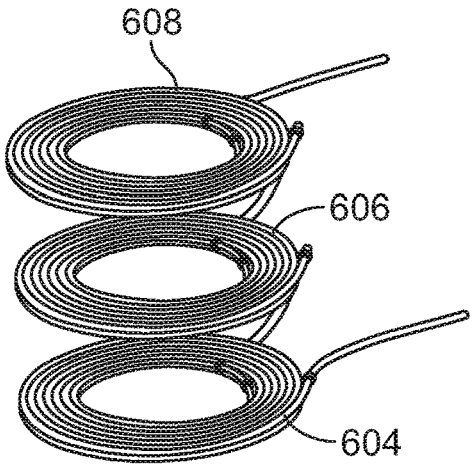
FIG. 7 is an isometric view of the three primary windings of the transformer of FIG. 6.

FIG. 6 illustrates an example power transformer 600 including the magnetic core 502 of FIG. 5 (sometimes referred to herein as a bottom core portion 502), a magnetic core 602 (sometimes referred to herein as a top core portion 602), and five windings 604, 606, 608, 610, 612 positioned adjacent the cores 502, 602. FIG. 7 illustrates the windings 604, 606, 608 of FIG. 6.

As shown in FIG. 6, the top core portion 602 has an "I" shaped core. Thus, when the top core portion 602 and the bottom core portion 502 (e.g., the "PQ" shaped core) are positioned adjacent each other, the core portions form a "PQI" core configuration. This combination of the bottom core portion 502 and the top core portion 602 may be collectively referred to a magnetic core.

Each winding 604, 606, 608 of FIGS. 6 and 7 is substantially similar to the winding 400 of FIG. 4. As such, each winding includes two layers (e.g., a double layer configuration) formed from a wire and turns adhered to each via a bonding material as explained above.

Additionally, and as shown in FIGS. 6 and 7, the windings 604, 606, 608 are continuous. For example, one wire may be used to form the winding 604, the winding 606, and the winding 608. Thus, the windings do not need to endure an interconnect process or the like to connect ends of the windings together. Alternatively, only two of the windings may be continuous or none of the windings may be continuous. For example, the winding 604 and the winding 606 may be continuous and the winding 608 may be connected to the winding 606 via an interconnect process.

Figure 9:
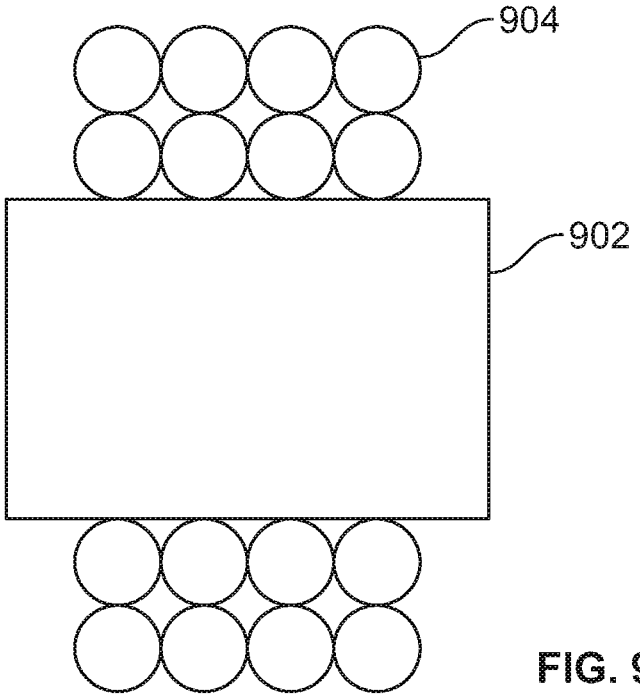
FIG. 9 is a side view of a winding formed on a mandrel according to another example embodiment.

Further, one or more of the windings 604, 606, 608 may be formed on the bottom core portion 502 as explained above. Alternatively, one or more of the windings 604, 606, 608 may be formed on another structure (e.g., a mandrel, etc.) and then placed on the magnetic core as explained above. For example, FIG. 9 illustrates a system including a mandrel 902 and a winding 904 formed on the mandrel 902. In the example of FIG. 9, the winding 904 may be formed by rotating the mandrel 902 causing a wire to wind about the mandrel 902, winding a wire about a stationary mandrel 902, etc.

As shown in FIG. 9, the winding 904 includes a double layer configuration with each layer including four turns. Alternatively, the winding 904 may include any other suitable configuration. For example, the winding 904 may include a single layer configuration, a mixed configuration of one or more single layers and one or more double layers, more than two layers, etc. Additionally, the winding 904 may include more or less than four turns. For example, the winding 904 may include two turns, six turns, nine turns, etc.

Referring back to FIG. 6, the windings 610, 612 are plate windings. These plate windings 610, 612 may be formed by a stamping process. In the example of FIG. 6, the plate windings 610, 612 are copper. Alternatively, the windings 610, 612 may be any suitable winding, may include any suitable material, and/or may be formed by any suitable process. For example, one or more windings 610, 612 may be similar to the winding 400 of FIG. 4.

In the example of FIG. 6, the windings 604, 606, 608 are primary windings of the transformer 600 and the plate windings 610, 612 are secondary windings of the transformer 600. Alternatively, the windings 604, 606, 608 may be secondary windings and the windings 610, 612 may be primary windings.

As shown in FIG. 6, the three primary windings 604, 606, 608 and the two secondary plate windings 610, 612 are positioned in an interleaved configuration. For example, the secondary plate winding 612 is positioned between the primary winding 604 and the primary winding 606 and the secondary plate winding 610 is positioned between the primary winding 606 and the primary winding 608. Thus, the primary windings and the secondary windings are positioned in a stacked alternating fashion (e.g., one primary winding, one secondary winding, another primary winding, etc.). As such, the transformer 600 does not include consecutively ordered secondary windings and/or primary windings. Alternatively, the windings 604, 606, 608, 610, 612 may be positioned in any other suitable manner.

Additionally, and as shown in FIG. 6, the three primary windings 604, 606, 608 and the two secondary plate windings 610, 612 are separable from each other. As such, each of the windings may be removed from the transformer 600 if desired. Thus, one or more of the windings may be modified (e.g., to a different configuration, etc.), repaired, replaced, etc.

Although FIG. 6 illustrates three primary windings and two secondary windings, it should be apparent to those skilled in the art that any suitable number of primary windings and/or secondary windings may be employed without departing from the scope of the disclosure. For example, the transformer 600 may include two primary windings and two secondary windings, five primary windings and four secondary windings, four primary windings and four secondary windings, two primary windings and three secondary windings, etc.

Figure 8A:
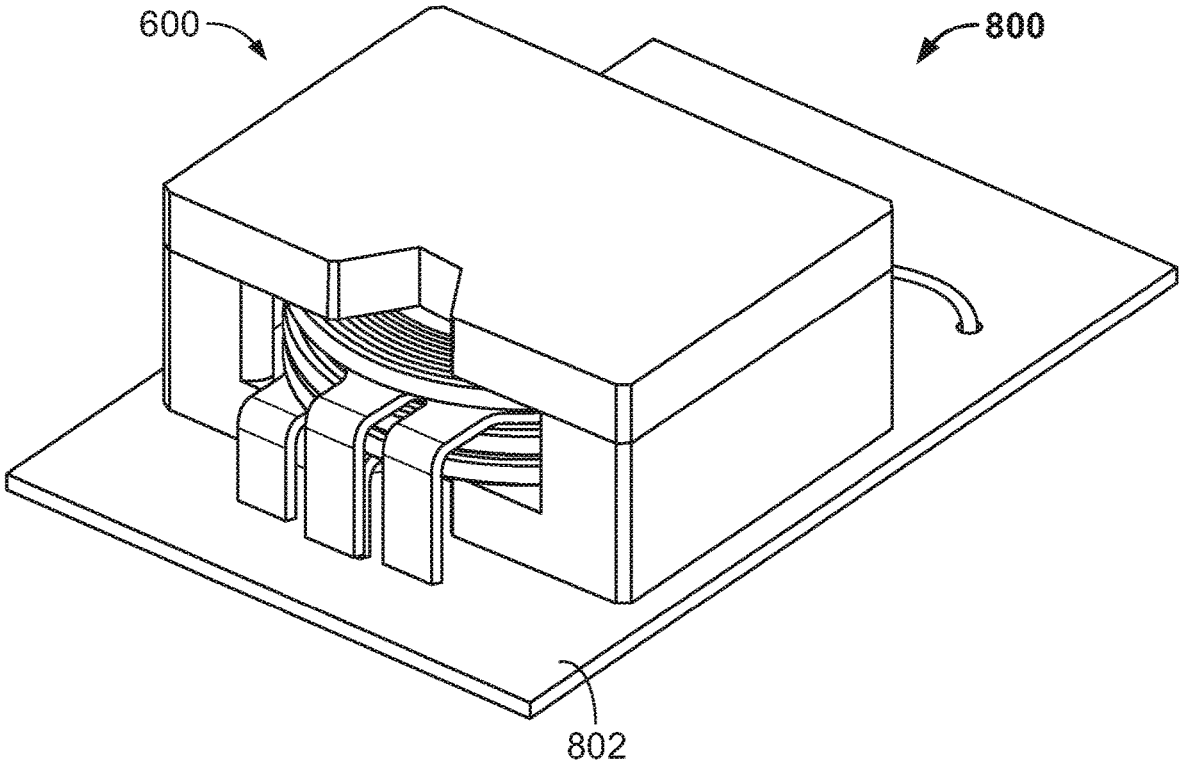
FIG. 8A is an isometric view of a power supply including a power board and the transformer of FIG. 6 coupled to the power board according to yet another example embodiment.
Figure 8B:
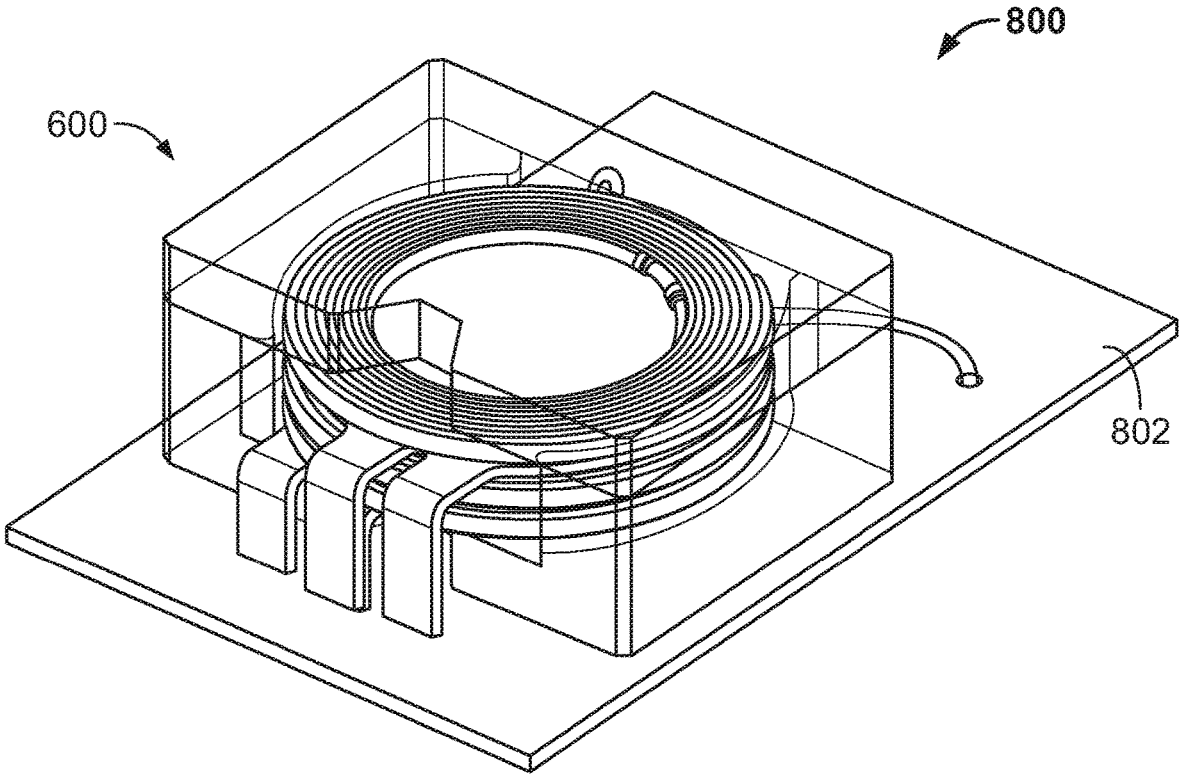
FIG. 8B is an isometric view of the power supply of FIG. 8A with the transformer core shown in phantom.

FIGS. 8A and 8B illustrate an example power supply 800 including a power board 802 and the power transformer 600 of FIG. 6 coupled to the power board 802 via the secondary and primary windings of the power transformer 600. FIG. 8B illustrates the core portions 502, 602 in phantom. Although not shown, the power supply 800 may include one or more other components (e.g., power switches, capacitors, inductors, etc.) coupled to the power board 802 and, if appropriate, to the power transformer 600. The power board 802 may be any suitable circuit board including, for example, a printed circuit board.

The windings having adhered turns disclosed herein may be formed from any suitable wire that is at least partially covered with a bonding material. For example, the bonding material may cover only the portion of the wire adjacent to contacting turns. In such cases, the bonding material may cover a bottom side of one portion of the wire (e.g., of one turn) and a top side of another portion of the wire (e.g., of another turn). Alternatively, the bonding material may substantially surround these portions of the wire. In other examples, the bonding material may cover the entire wire. In such examples, the bonding material may overcoat the entire wire, overcoat portions of the wire, etc.

Figure 10:
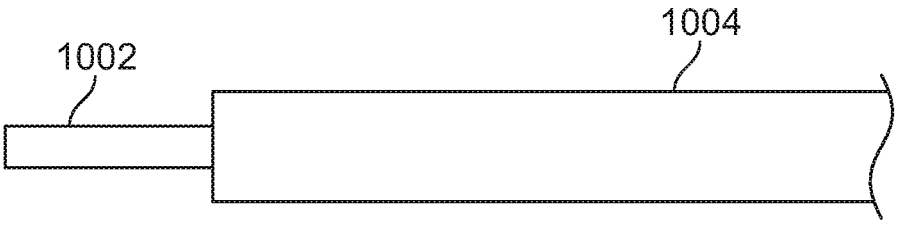
FIG. 10 is a side view of a wire including a bonding material according to yet another example embodiment.
Figure 11:
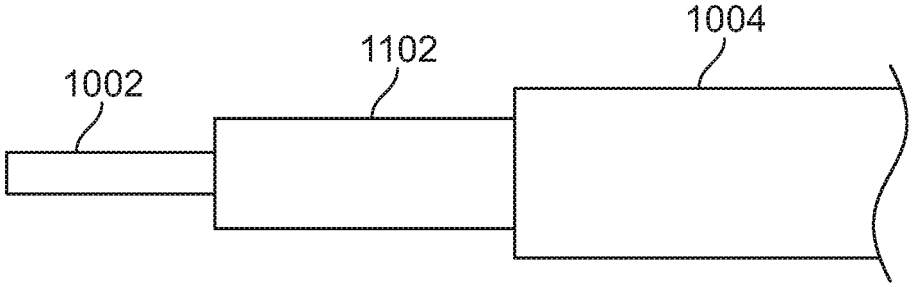
FIG. 11 is a side view of a wire including insulation and a bonding material according to another example embodiment.

The wires disclosed herein may be any suitable wire. In some embodiments, the wire forming a winding may be a magnetic wire. For example, FIG. 10 illustrates a wire 1002 partially covered by a bonding material 1004. In other embodiments, the wire (e.g., a magnetic wire, etc.) may be an insulated wire, etc. In such cases, the wires may include a single layer of insulation, two or more layers of insulation. For example, FIG. 11 illustrates the wire 1002 including insulation 1102 that is partially covered by the bonding material 1004. In some preferred embodiments, the wires include three layers of insulation (e.g., commonly known as a triple insulated wire). In other examples, the wires may include multi wire strands (e.g., a litz wire, etc.).

The bonding materials disclosed herein may any suitable adhesive material depending on, for example, wire size, tackiness of the bonding material, and/or various other characteristics of the windings and/or bonding material. For example, the bonding material may be one or more cyanoacrylates and include one or more polymers, etc. In some examples, one area of the wire may be at least partially covered by one bonding material and another area of the wire may be at least partially covered by another bonding material. The bonding materials (whether the same or not) may be bonded together through cross-linking and/or another suitable process initiated by heat as explained above.

Additionally, although the figures illustrate windings having a particular number of layers and/or turns, a particular shape, etc., it should be apparent to those skilled in the art that the windings may include any suitable number of layers and/or turns, shape, etc. without departing from the scope of the disclosure. For example, the windings may include a single layer, two layers (e.g., a double layer configuration), a mixed layer configuration, more than two layers, etc. Additionally, any of the windings may include two turns as shown in FIG. 3, three turns, four turns as shown in FIG. 9, five turns, six turns as shown in FIG. 4, fifteen turns, etc. Further, each of the layers, turns, etc. of each winding and/or multiple windings may be continuous (e.g., a continuous wire) as explained above and/or individual wires coupled together via, for example, an interconnect process, etc.

Figure 12:
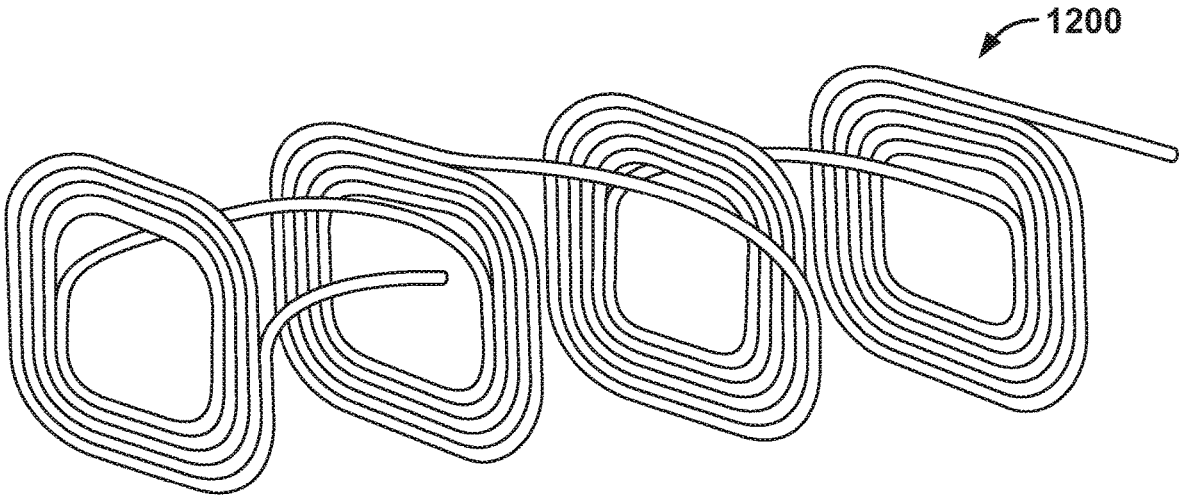
FIG. 12 is an isometric view of four substantially rectangular winding each having a single layer configuration according to yet another example embodiment.
Figure 13:
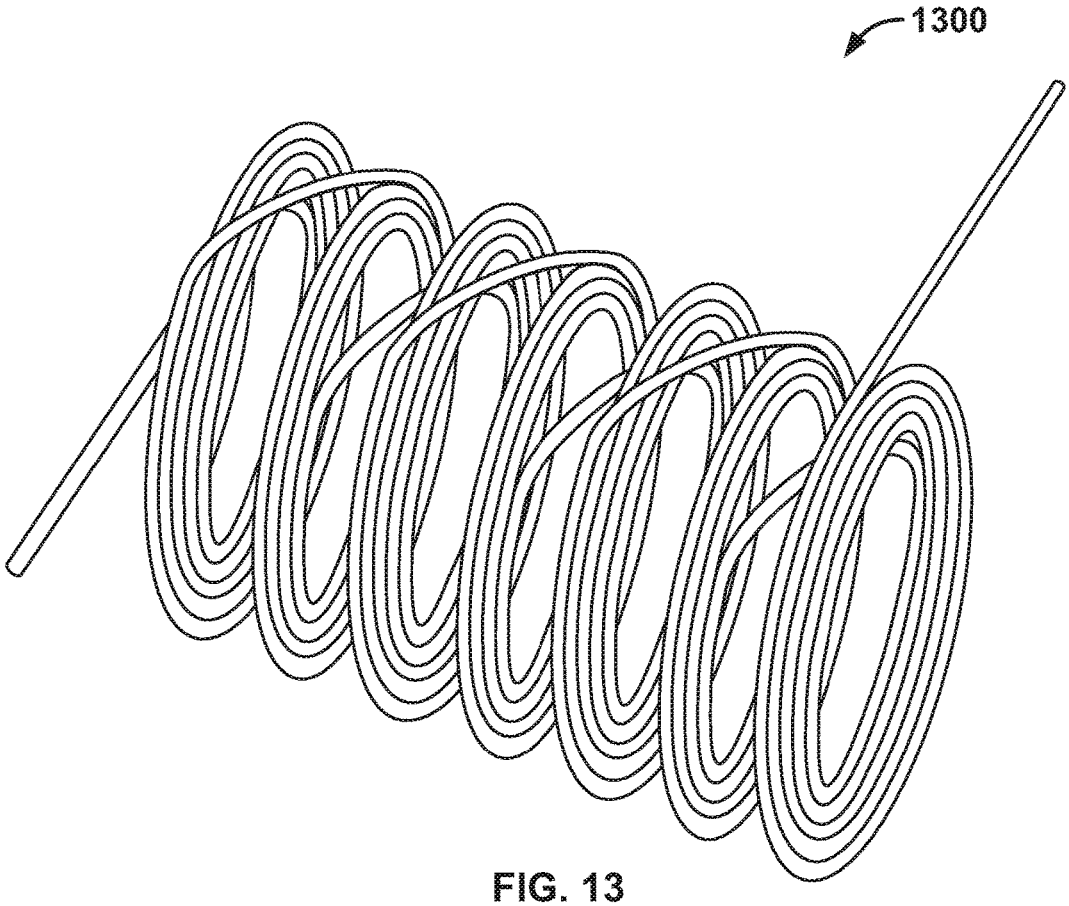
FIG. 13 is an isometric view of seven substantially circular windings each having a single layer configuration according to another example embodiment.
Figure 14:
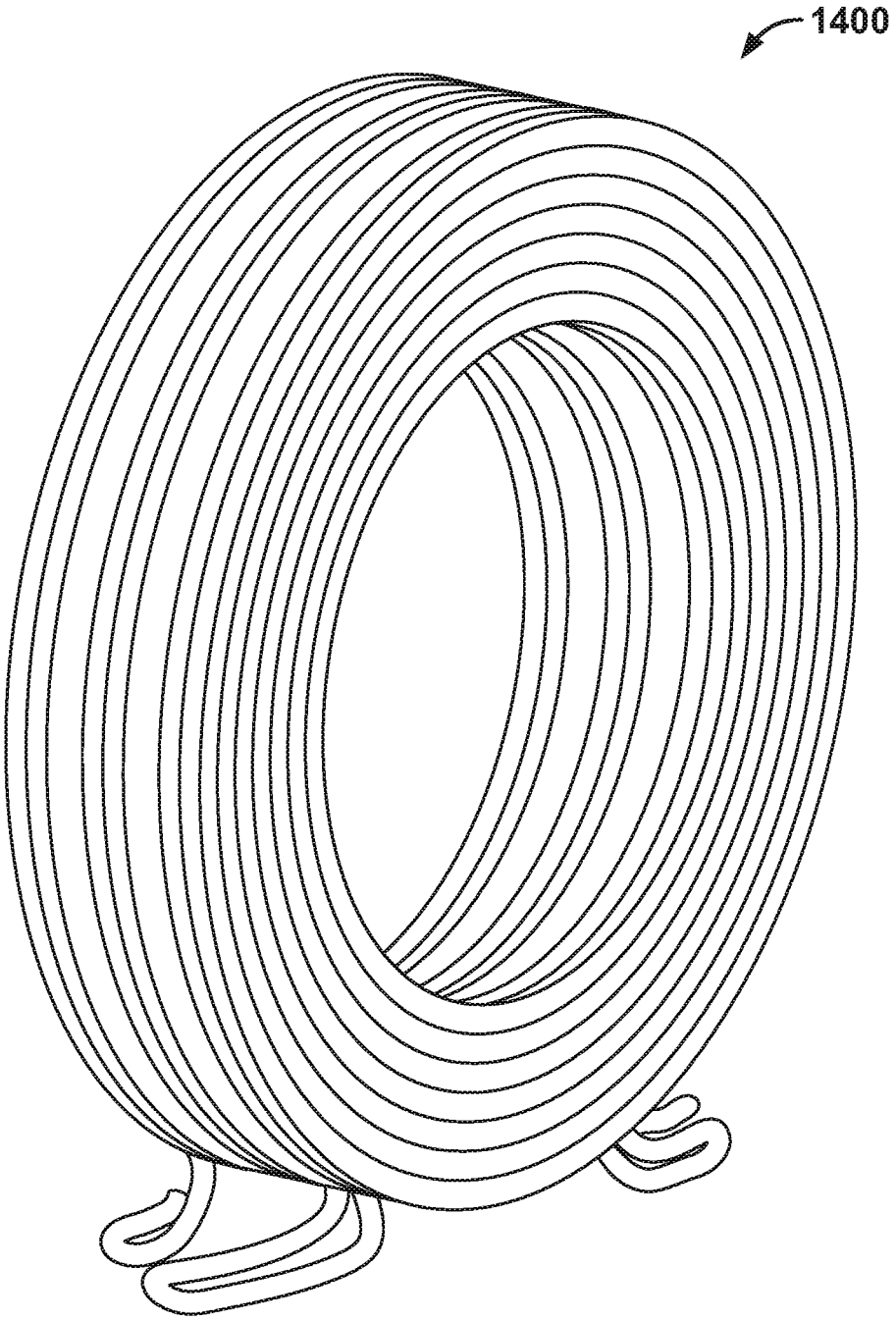
FIG. 14 is an isometric view of three substantially circular windings each having a double layer configuration according to yet another example embodiment.

Further, the windings may include a substantially circular shape (e.g., the winding 400 of FIG. 4, the windings 604, 606, 608 of FIG. 6, etc.), a substantially rectangular shape (e.g., a rectangle, a square, etc.), a substantially oval shape, etc. For example, FIG. 12 illustrates four windings 1200, each including a single layer configuration. The inner and outer circumference of each winding includes a substantially rectangular shape. FIG. 13 illustrates seven windings 1300, each including a single layer configuration. As shown in FIG. 13, the inner and outer circumference of each winding includes a substantially circular shape. FIG. 14 illustrates three windings 1400, each having a double layer configuration. Like the windings of FIG. 13, the inner and outer circumference of each winding of FIG. 14 includes a substantially circular shape.

Alternatively, the inner circumference of the windings (e.g., any of the windings of FIGS. 3-9, 12 and 13) may include one shape (e.g., a substantially circular shape) and the outer circumference of the winding may include another shape (e.g., a substantially rectangular shape).

The magnetic cores disclosed herein may be any suitable core including one or more materials. For example, the cores may be a ferrite core and include iron, iron alloys, cobalt, cobalt alloys, etc. In other embodiments, the cores may include silicon laminates such as laminated silicon steel, etc. Additionally, the cores may include one or more core portions to form any suitable shaped core including, for example, a "PQI" shaped core (as shown in FIGS. 6, 8A and 8B), a "U" shaped core, an "PQ" shaped core (as shown in FIG. 5), an "EI" shaped core, an "E" shaped core, etc.

The windings disclosed herein may be employed in any suitable application. For example, the windings may be used for inductor coils, transformer windings, etc. As such, the windings may form an inductor, part of a transformer, etc. of power supplies (e.g., switched mode power supplies, uninterruptible power supplies, etc.), converters (e.g., flyback converters, buck converters, boost converters, etc.), etc. The power supplies, converters, etc. may be employed in low power rated devices such as electronic device chargers, battery chargers, etc. and/or any other suitable device.

When employed in a transformer (e.g., the transformer 600 of FIG. 6), the windings may allow the transformer to have increased efficiency, a higher power density, a lower profile, etc. than other known transformers. For example, the transformer may have increased efficiency due at least in part to a stacked configuration which may substantially eliminate unbalanced resistance components (e.g. improve the resistance ratio Rac/Rdc), electrical coupling, etc. Additionally, the power density of the transformer 600 of FIG. 6 may be about 1.4 KW/cubic inch.

Additionally, and as explained above, the windings may include a reduced profile compared to other known windings. Thus, more windings may be positioned in a transformer core winding window in a stacked configuration due to this reduced profile. Further, the windings disclosed herein may be manufactured without employing various typically required components. For example, the windings may be manufactured without using a coil former, fixing tape (e.g., polyester, polyamide, etc. tapes for preventing wires from contacting a core, securing various stacked windings in place, etc.), etc.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A method of manufacturing a power transformer, the method comprising:

forming a first layer and a second layer of a first winding having a plurality of turns from a wire at least partially covered with a bonding material, the first layer having at least two adjacent turns of said plurality of turns;

heating the bonding material to adhere the at least two adjacent turns of said plurality of turns together, wherein forming the first layer and the second layer of the first winding includes forming the first layer and forming the second layer on the first layer after the at least two adjacent turns are adhered together; and after heating the bonding material, positioning the first winding adjacent a second winding.

2. The method of claim 1 wherein forming the first winding includes forming the first winding on a structure.

3. The method of claim 2 wherein the structure includes a magnetic core.

4. The method of claim 2 wherein the structure includes a mandrel.

5. The method of claim 4 further comprising positioning the first winding and the second winding adjacent a magnetic core.

6. The method of claim 1 wherein heating the bonding material includes heating the bonding material to a defined temperature for a defined period of time.

7. The method of claim 6 wherein the defined temperature includes a temperature no more than about 260 degrees Celsius.

8. The method of claim 1 wherein heating the bonding material includes passing heated air across the bonding material.

9. The method of claim 1 wherein the first winding includes a primary winding of the power transformer and wherein the second winding includes a secondary winding of the power transformer.

10. The method of claim 1 wherein the forming step and the heating step are automated.

* * * * *